United States Patent [19]

Morden

[11] Patent Number: 4,472,951

[45] Date of Patent: Sep. 25, 1984

[54] COMBINATION LOCK

[76] Inventor: Lawrence E. Morden, 40 Barrington Ave., Toronto, Ontario, Canada, M4C 4Y7

[21] Appl. No.: 337,980

[22] Filed: Jan. 8, 1982

[51] Int. Cl.[3] ..... E05B 37/06; E05B 47/00

[52] U.S. Cl. ..... 70/25; 70/276

[58] Field of Search ..... 70/22–30, 70/276

[56] References Cited

U.S. PATENT DOCUMENTS

| | | | |
|---|---|---|---|
| 162,952 | 5/1875 | Root | 70/29 |
| 210,056 | 11/1878 | Savage | 70/332 |
| 1,316,037 | 9/1919 | Hewitt | 70/312 |
| 1,825,467 | 9/1931 | Miller | 70/312 |
| 1,929,598 | 10/1933 | Miller | 70/312 |
| 2,893,231 | 7/1959 | Soref et al. | 70/25 |
| 3,192,746 | 7/1965 | Lehman | 70/315 |
| 3,256,723 | 6/1966 | Lehman | 70/25 |
| 3,274,811 | 9/1966 | Ethington | 70/301 |
| 3,388,572 | 6/1968 | Morin | 70/315 |
| 3,494,157 | 2/1970 | Coker | 70/276 |
| 3,546,906 | 12/1970 | Yang | 70/21 |
| 3,592,027 | 8/1971 | Wako | 70/25 |
| 3,691,328 | 9/1972 | Davidson | 200/43 |
| 3,742,739 | 7/1973 | Hickman | 70/276 X |
| 3,967,477 | 7/1976 | Harrington et al. | 70/25 X |
| 4,287,733 | 9/1981 | Gomez-Olea | 70/276 |

FOREIGN PATENT DOCUMENTS

| | | | |
|---|---|---|---|
| 127142 | 3/1948 | Australia | 70/29 |
| 2248720 | 5/1975 | France | 70/25 |
| 2254976 | 7/1975 | France | 70/276 |

*Primary Examiner*—Gary L. Smith
*Assistant Examiner*—Lloyd A. Gall
*Attorney, Agent, or Firm*—Ridout & Maybee

[57] ABSTRACT

A combination lock is disclosed which employs magnetic forces to rotate the tumblers in unison when not being urged by aligning means. The aligning means are pins on the tumblers and abutment surfaces in the front and back plates of the lock so that the combination can be dialed without the necessity of rotating the tumblers through a complete 360°.

4 Claims, 5 Drawing Figures

COMBINATION LOCK

This invention relates generally to the field of combination locks and particularly to an improved low and medium security lock.

Combination locks generally contain a number of rotatable wafers, code elements or tumblers which engage pins to align such tumblers upon turning of the outside knob to designated alphanumeric positions. It is advantageous that such tumblers rotate together unless urged by the various aligning elements and be positively positioned inside the lock. In the conventional commercially available locks such as those manufactured by Walsco (trade mark) or Slaymaker (trade mark), there are placed springs and spacers for this purpose. In Ethington, U.S. Pat. No. 3,274,811, issued Sept. 27, 1966, a slip coupling is provided.

In addition, presently commercially available locks have the disadvantage of requiring that the tumblers must be aligned by the well-known manner of dialing complete revolutions of the dial, usually three one way, two another and one back. This is awkward where speed and convenience of opening and closing are desired.

Finally, presently commercially available locks cannot be locked except in the position in which all the tumblers are aligned. This means that if the tumblers are turned after opening, the combination must be redialed to enable the lock to be closed.

Thus the invention in one of its aspects, uses a magnet as at least one of the tumblers and has other tumblers of a magnetizable material so that magnetic forces cause the tumblers to rotate as a unit unless urged by some aligning means.

In another of its aspects, the invention provides a means for dialing the combination without rotating the dial through a complete revolution. The dial is moved to a clearing position, then to one segment of the dial, then back to another segment, then to the open position.

In yet another aspect of the invention, means are provided to enable the lock to be closed when the tumblers are not aligned. Such means are generally an articulated coupling mounted on a dog.

Thus the invention in its broad aspect consists of a combination lock comprising:

A combination lock having tumblers rotatably mounted in a housing, the tumblers each having an opening thereon, means for aligning the openings upon rotation of the tumblers, a shackle mounted in the housing, means for locking the shackle in the housing and releasing said shackle when the openings are in alignment, in which the tumblers are made to move in unison by magnetic forces when not urged by said aligning means.

In a more specific aspect, the invention consists of:

A combination lock comprising:

(a) a housing having a front and back plate wherein the inner faces of said front and back plates have abutment surfaces and the outer face of said front plate has an additional abutment surface, (b) a shaft rotably secured in the housing and extending substantially perpendicularly from the back plate through the front plate, (c) a generally disc shaped first tumbler fixed on the shaft for rotation therewith having at least one alignable opening thereon, (d) second and third disc shaped tumblers coaxially riding on the shaft on each side of said first tumbler, each tumbler having at least one alignable opening thereon and in which at least one of said first, second or third tumblers is a magnet and the others are composed of a magnetizable material so that they normally rotate as a unit, (e) each of said second and third tumblers having at least one stop pin arranged so that a stop pin of one of the tumblers projects toward the front plate and a stop pin of the other tumbler projects toward the back plate so that the pins can engage the abutment surfaces to align the openings when the shaft is rotated, (f) a knob fixed on the part of the shaft extending through the front plate and having an abutment surface for engaging the abutment surface on the outside of the front plate to align the first tumbler, (g) a shackle mounted in the housing and moveable from a position engaged in the lock to a released position, (h) means for engaging the shackle and for releasing it when the openings of the tumblers are aligned.

The invention will be understood more fully in light of the drawings in which.

Figure 2:
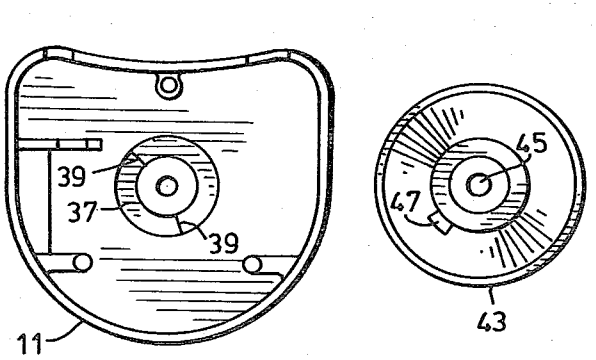
FIG. 2 is an exploded view of the tumblers and of the means for aligning the tumblers.
Figure 3:
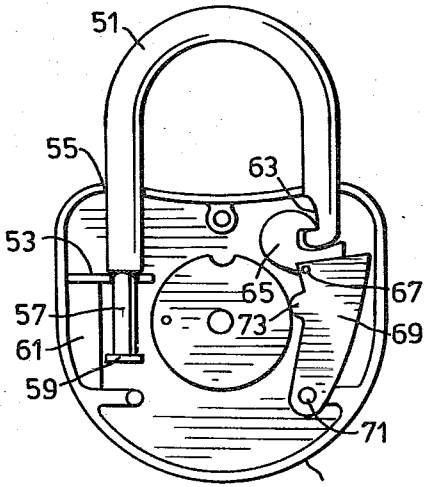
FIG. 3 is a view of the lock with the back plate removed.
Figure 1:
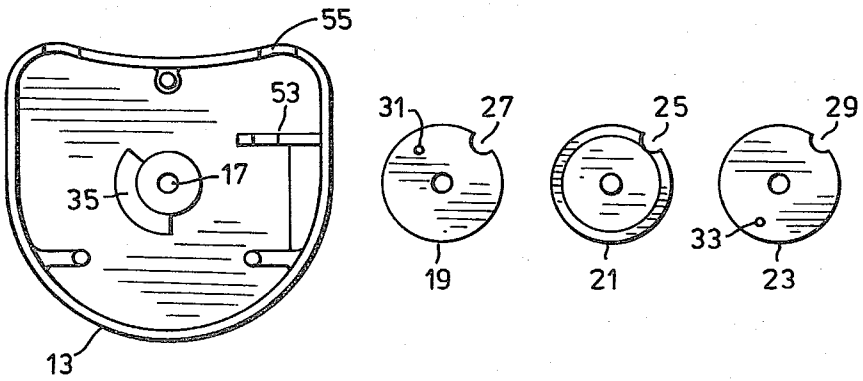
FIG. 1 is an exploded side view of the components of the combination lock.
Figure 1:
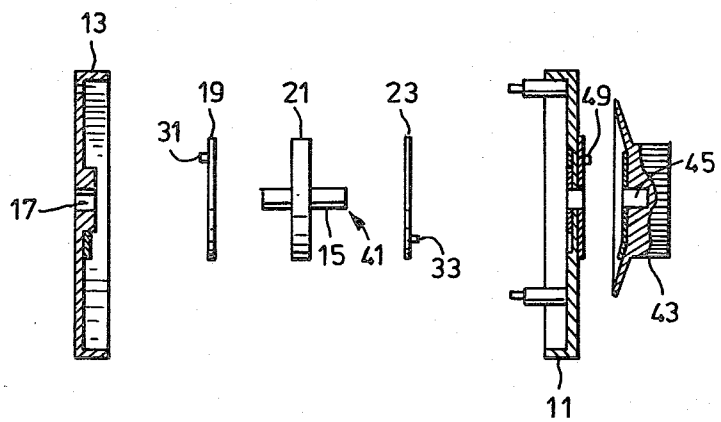
Figure 4:
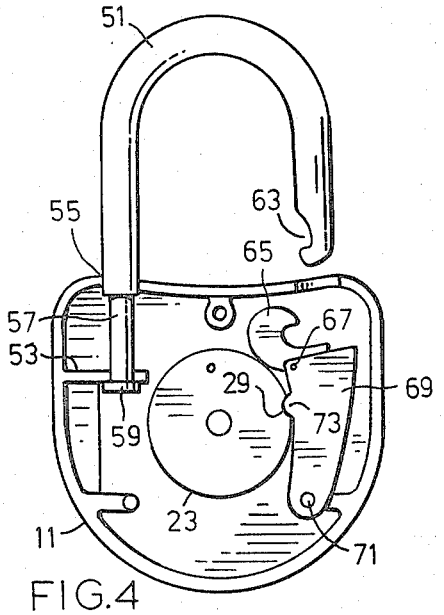
FIG. 4 is a view of the lock as shown in FIG. 3 in open position.
Figure 5:
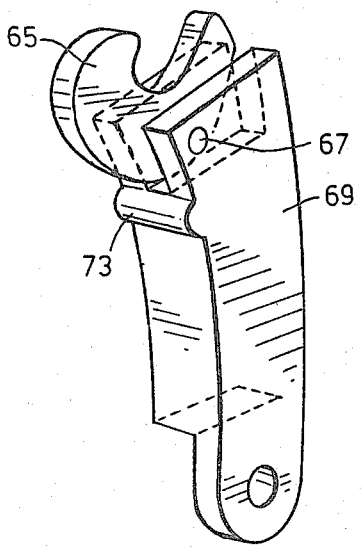
FIG. 5 is a view of the dog and coupling.

In FIGS. 1, 2 and 3, the combination lock shown has a housing which consists of a front plate 11 and a back plate 13. A shaft 15 is sized to fit into a recess 17 in the back plate 13 and extends through tumblers 19, 21 and 23 and through front plate 11. Tumbler 21 is a flat disc fixed to the shaft and rotates with it. It is a magnet or is magnetized and has an opening 25 therein on its circumference.

Tumblers 19 and 23 are identical flat discs and are made of magnetizable material. They are freely rotatable about shaft 15 but normally move with tumbler 21 and the shaft 15 because of magnetic forces, unless aligned as below described. Tumblers 19 and 23 contain openings 27 and 29 on their circumference similar to opening 25 and identical stop pins 31 and 33 project from the surface of the disc. The tumblers 19 and 23 are mounted on the shaft so that their flat faces face towards tumbler 21 and their stop pins project toward the back plate 13 and the front plate 11 respectively.

An annular abutment surface 35 is contained on the back plate and consists, in this embodiment, of a raised piece of metal. In operation, stop pin 31 on tumbler 19 engages surface 35.

In the front plate 11, an annular recess 37 provides abutment faces at 39. In operation stop pin 33 travels in annular recess 37 to engage annular surfaces at 39.

The shaft 15 extends through front plate 11 as stated and has a keyed or beveled end at 41 (not shown). Dial 43 has a recess 45 for receiving end 41. The dial is glued, friction fitted or fixed in some manner to the shaft 15 to rotate the shaft when the dial is turned. Dial 43 contains abutment surface 47 which contacts stop pin 49 on the front surface of front plate 11 so that the dial 43 can not be rotated a completerevolution. In practice, dial 43 is rotated clockwise until abutment surface 47 contacts stop pin 49 and this is the clearing or start position to commence the dialing of the combination.

The lock has a shackle 51 mounted for up and down and turning movement in support 53 and recess 55 on the front and back plates 11 and 13. The shackle end 57 rides in the support 53 and has an enlarged portion 59 which cannot fit through support 53 when the front and back plate are closed. Enlarged portion 59 rides against block 61 for more rigid movement of the shackle.

The shackle 51 has a notch 63 which can engage an articulated coupling 65. The coupling 65 pivots about pin 67 in a recess in dog 69 which in turn is mounted for pivotal movement about post 71. The dog 69 has a projection 73 which can engage openings 25, 27 and 29 in the tumblers when they are aligned to move dog 69 and open shackle 51. Because of the articulated coupling 65, the shackle 51 can be closed in any position.

In practice, the combination has been set by the placement of the pins 31 and 33 and the abutment surfaces 35, 39 and 49 and the openings 25, 27 and 29. Once a stop pin engages an abutment surface, rotation of the dial 43 continues in that direction until the openings in the tumblers are aligned at the pre-set combination. Normally the combination will be dialed counterclockwise to a number in one quadrant, then clockwise to a number in a different quadrant and then counterclockwise to a third number to open. The dial will not be turned a whole revolution at any time as in conventional combination locks. With this embodiment, it is not possible to have two or three numbers from the same quadrant as 333 in a conventional lock, but there are still sufficient number possibilities for adequate security in many applications.

The invention has been described by means of a specific example and a specific embodiment, but obvious limitations will occur to those skilled in the art without departing from the spirit and scope of the invention.

I claim:

1. A combination lock comprising:

(a) a housing having a front and back plate wherein the inner faces of said front and back plates have abutment surfaces and the outer face of said front plate has an additional abutment surface, (b) a shaft rotatably secured in the housing and extending substantially perpendicularly from the back plate through the front plate, (c) a generally disc shaped first tumbler fixed on the shaft for rotation therewith having at least one alignable opening thereon, (d) second and third disc shaped tumblers coaxially riding on the shaft one on each side of said first tumbler, each tumbler having at least one alignable opening thereon and in which at least one of said first, second or third tumblers is a magnet and the others are composed of a magnetizable material so that they normally rotate as a unit, (e) each of said second and third tumblers having at least one stop pin arranged so that a stop pin of one of the tumblers projects toward the front plate and a stop pin of the other tumbler projects toward the back plate so that the pins can engage the abutment surfaces to align the openings when the shaft is rotated, (f) a knob fixed on the part of the shaft extending through the front plate and having an abutment surface for engaging the abutment surface on the outer face of the front plate to align the first tumbler, (g) a shackle mounted in the housing and moveable from a position engaged in the lock to a released position, (h) means for engagihg the shackle and for releasing it when the openings of the tumblers are aligned.

2. A combination lock as claimed in claim 1 in which the means for engaging and releasing the shackle comprise a dog pivotably mounted in said housing for engaging the openings of the tumblers when aligned and an articulated coupling mounted on said dog to allow said shackle to be locked when said dog is not engaged in said openings.

3. A combination lock as in claim 1 in which the first tumbler is the magnet.

4. A combination lock as claimed in claim 1 in which the tumbler openings are aligned by rotation of a point on the knob into three successive quadrants without a complete 360° revolution of the knob.

* * * * *